US011134335B2

(12) United States Patent
Dalmas, II et al.

(10) Patent No.: US 11,134,335 B2
(45) Date of Patent: Sep. 28, 2021

(54) AUDIO SOURCE WAVEGUIDE

(71) Applicant: Quest Engines, LLC, Coopersburg, PA (US)

(72) Inventors: Elario D. Dalmas, II, Macungie, PA (US); Brett J. Leathers, Allentown, PA (US)

(73) Assignee: QUEST ENGINES, LLC

( * ) Notice: Subject to any disclaimer, the term of this patent is extended or adjusted under 35 U.S.C. 154(b) by 436 days.

(21) Appl. No.: 16/256,289

(22) Filed: Jan. 24, 2019

(65) Prior Publication Data

US 2019/0238975 A1 Aug. 1, 2019

Related U.S. Application Data

(60) Provisional application No. 62/622,645, filed on Jan. 26, 2018.

(51) Int. Cl.

| | |
|---|---|
| ***H04R 1/28*** | (2006.01) |
| ***H04R 19/02*** | (2006.01) |
| ***H04R 1/02*** | (2006.01) |
| ***F02B 17/00*** | (2006.01) |
| ***F02M 61/08*** | (2006.01) |
| ***F02M 61/16*** | (2006.01) |
| ***F02M 61/18*** | (2006.01) |

(52) U.S. Cl.

CPC ..... *H04R 1/2826* (2013.01); *F02B 17/005* (2013.01); *F02M 61/08* (2013.01); *F02M 61/166* (2013.01); *F02M 61/18* (2013.01); *H04R 1/026* (2013.01); *H04R 1/2803* (2013.01); *H04R 1/2888* (2013.01); *H04R 19/02* (2013.01); *H04R 1/2896* (2013.01); *H04R 2201/029* (2013.01); *H04R 2499/13* (2013.01)

(58) Field of Classification Search

None

See application file for complete search history.

(56) References Cited

U.S. PATENT DOCUMENTS

| | | | |
|---|---|---|---|
| 1,016,561 | A | 2/1912 | Grabler |
| 1,046,359 | A | 12/1912 | Winton |
| 1,329,559 | A | 2/1920 | Tesla |

(Continued)

FOREIGN PATENT DOCUMENTS

| | | |
|---|---|---|
| CN | 201526371 | 7/2010 |
| CN | 106321916 | 1/2017 |

(Continued)

OTHER PUBLICATIONS

Graunke, K. et al., "Dynamic Behavior of Labyrinth Seals in Oilfree Labyrinth-Piston Compressors" (1984). International Compressor Engineering Conference. Paper 425. http://docs.lib.purdue.edu/icec/425.

(Continued)

*Primary Examiner* — Kenny H Truong

(74) *Attorney, Agent, or Firm* — Yohannan Law; David R Yohannan

(57) ABSTRACT

Embodiments of apparatus for affecting air flow and/or pressure wave propagation in relation to an audio source enclosure are disclosed. The apparatus may include two waveguide sections mounted within an audio source enclosure. The waveguide sections may include complementary nested first and second funnels disposed relative to each other in a manner to channel air flow in and/or from the enclosure.

25 Claims, 11 Drawing Sheets

(56) References Cited

U.S. PATENT DOCUMENTS

| | | | |
|---|---|---|---|
| 1,418,838 | A | 6/1922 | Setz |
| 1,511,338 | A | 10/1924 | Cyril |
| 1,527,166 | A | 2/1925 | Maurice |
| 1,639,308 | A | 8/1927 | Orr |
| 1,869,178 | A | 7/1932 | Thuras |
| 1,967,682 | A | 7/1934 | Ochtman, Jr. |
| 1,969,704 | A | 8/1934 | D'Alton |
| 2,025,297 | A | 12/1935 | Meyers |
| 2,224,475 | A | 12/1940 | Evans |
| 2,252,914 | A | 8/1941 | Balton |
| 2,283,567 | A | 5/1942 | Barton |
| 2,442,917 | A | 6/1948 | Butterfield |
| 2,451,271 | A | 10/1948 | Balster |
| 2,468,976 | A | 5/1949 | Herreshoff |
| 2,471,509 | A | 5/1949 | Anderson |
| 2,878,990 | A | 3/1950 | Zurcher |
| 2,644,433 | A | 7/1953 | Anderson |
| 2,761,516 | A | 9/1956 | Vassilkovsky |
| 2,766,839 | A | 10/1956 | Baruch |
| 2,898,894 | A | 8/1959 | Holt |
| 2,915,050 | A | 12/1959 | Allred |
| 2,956,738 | A | 10/1960 | Rosenschold |
| 2,977,943 | A | 4/1961 | Lieberherr |
| 2,979,046 | A | 4/1961 | Hermann |
| 3,033,184 | A | 5/1962 | Jackson |
| 3,035,879 | A | 5/1962 | Jost |
| 3,113,561 | A | 12/1963 | Heintz |
| 3,143,282 | A | 8/1964 | McCrory |
| 3,154,059 | A | 10/1964 | Witzky |
| 3,171,425 | A | 3/1965 | Berlyn |
| 3,275,057 | A | 9/1966 | Trevor |
| 3,399,008 | A | 8/1968 | Farrell |
| 3,409,410 | A | 11/1968 | Spence |
| 3,491,654 | A | 1/1970 | Zurcher |
| 3,534,771 | A | 10/1970 | Everdam |
| 3,621,821 | A | 11/1971 | Jarnuszkiewicz |
| 3,749,318 | A | 7/1973 | Cottell |
| 3,881,459 | A | 5/1975 | Gaetcke |
| 3,892,070 | A | 7/1975 | Bose |
| 3,911,753 | A | 10/1975 | Daub |
| 3,973,532 | A | 8/1976 | Litz |
| 4,043,224 | A | 8/1977 | Quick |
| 4,046,028 | A | 9/1977 | Vachris |
| 4,077,429 | A | 3/1978 | Kimball |
| 4,127,332 | A | 11/1978 | Thiruvengadam |
| 4,128,388 | A | 12/1978 | Freze |
| 4,164,988 | A | 8/1979 | Virva |
| 4,182,282 | A | 1/1980 | Pollet |
| 4,185,597 | A | 1/1980 | Cinquegrani |
| 4,271,803 | A | 6/1981 | Nakanishi |
| 4,300,499 | A | 11/1981 | Nakanishi |
| 4,312,305 | A | 1/1982 | Noguchi |
| 4,324,214 | A | 4/1982 | Garcea |
| 4,331,118 | A | 5/1982 | Cullinan |
| 4,332,229 | A | 6/1982 | Schuit |
| 4,343,605 | A | 8/1982 | Browning |
| 4,357,916 | A | 11/1982 | Noguchi |
| 4,383,508 | A | 5/1983 | Irimajiri |
| 4,467,752 | A | 8/1984 | Yunick |
| 4,480,597 | A | 11/1984 | Noguchi |
| 4,488,866 | A | 12/1984 | Schirmer |
| 4,541,377 | A | 9/1985 | Amos |
| 4,554,893 | A | 11/1985 | Vecellio |
| 4,570,589 | A | 2/1986 | Fletcher |
| 4,576,126 | A | 3/1986 | Ancheta |
| 4,592,318 | A | 6/1986 | Pouring |
| 4,597,342 | A | 7/1986 | Green |
| 4,598,687 | A | 7/1986 | Hayashi |
| 4,669,431 | A | 6/1987 | Simay |
| 4,715,791 | A | 12/1987 | Berlin |
| 4,724,800 | A | 2/1988 | Wood |
| 4,756,674 | A | 7/1988 | Miller |
| 4,788,942 | A | 12/1988 | Pouring |
| 4,836,154 | A | 6/1989 | Bergeron |
| 4,874,310 | A | 10/1989 | Seemann |
| 4,879,974 | A | 11/1989 | Alvers |
| 4,919,611 | A | 4/1990 | Flament |
| 4,920,937 | A | 5/1990 | Sasaki |
| 4,936,269 | A | 6/1990 | Beaty |
| 4,969,425 | A | 11/1990 | Slee |
| 4,990,074 | A | 2/1991 | Nakagawa |
| 4,995,349 | A | 2/1991 | Tuckey |
| 5,004,066 | A | 4/1991 | Furukawa |
| 5,007,392 | A | 4/1991 | Niizato |
| 5,020,504 | A | 6/1991 | Morikawa |
| 5,083,539 | A | 1/1992 | Cornelio |
| 5,154,141 | A | 10/1992 | McWhorter |
| 5,168,843 | A | 12/1992 | Franks |
| 5,213,074 | A | 5/1993 | Imagawa |
| 5,222,879 | A | 6/1993 | Kapadia |
| 5,251,817 | A | 10/1993 | Ursic |
| 5,343,618 | A | 9/1994 | Arnold |
| 5,357,919 | A | 10/1994 | Ma |
| 5,390,634 | A | 2/1995 | Walters |
| 5,397,180 | A | 3/1995 | Miller |
| 5,398,645 | A | 3/1995 | Haman |
| 5,454,712 | A | 10/1995 | Yap |
| 5,464,331 | A | 11/1995 | Sawyer |
| 5,479,894 | A | 1/1996 | Noltemeyer |
| 5,694,891 | A | 12/1997 | Liebich |
| 5,714,721 | A | 2/1998 | Gawronski |
| 5,779,461 | A | 7/1998 | Iizuka |
| 5,791,303 | A | 8/1998 | Skripov |
| 5,872,339 | A | 2/1999 | Hanson |
| 5,937,821 | A | 8/1999 | Oda |
| 5,957,096 | A | 9/1999 | Clarke |
| 6,003,488 | A | 12/1999 | Roth |
| 6,019,188 | A | 2/2000 | Nevill |
| 6,119,648 | A | 9/2000 | Araki |
| 6,138,616 | A | 10/2000 | Svensson |
| 6,138,639 | A | 10/2000 | Hiraya |
| 6,199,369 | B1 | 3/2001 | Meyer |
| 6,205,962 | B1 | 3/2001 | Berry, Jr. |
| 6,237,164 | B1 | 5/2001 | LaFontaine |
| 6,257,180 | B1 | 7/2001 | Klein |
| 6,363,903 | B1 | 4/2002 | Hayashi |
| 6,382,145 | B2 | 5/2002 | Matsuda |
| 6,418,905 | B1 | 7/2002 | Baudlot |
| 6,446,592 | B1 | 9/2002 | Wilksch |
| 6,474,288 | B1 | 11/2002 | Blom |
| 6,494,178 | B1 | 12/2002 | Cleary |
| 6,508,210 | B2 | 1/2003 | Knowlton |
| 6,508,226 | B2 | 1/2003 | Tanaka |
| 6,536,420 | B1 | 3/2003 | Cheng |
| 6,639,134 | B2 | 10/2003 | Schmidt |
| 6,668,703 | B2 | 12/2003 | Gamble |
| 6,682,313 | B1 | 1/2004 | Sulmone |
| 6,691,932 | B1 | 2/2004 | Schultz |
| 6,699,031 | B2 | 3/2004 | Kobayashi |
| 6,705,281 | B2 | 3/2004 | Okamura |
| 6,718,938 | B2 | 4/2004 | Szorenyi |
| 6,758,170 | B1 | 7/2004 | Walden |
| 6,769,390 | B2 | 8/2004 | Hattori |
| 6,814,046 | B1 | 11/2004 | Hiraya |
| 6,832,589 | B2 | 12/2004 | Kremer |
| 6,834,626 | B1 | 12/2004 | Holmes |
| 6,971,379 | B2 | 12/2005 | Sakai |
| 6,973,908 | B2 | 12/2005 | Paro |
| 7,074,992 | B2 | 7/2006 | Schmidt |
| 7,150,609 | B2 | 12/2006 | Kiem |
| 7,261,079 | B2 | 8/2007 | Gunji |
| 7,296,545 | B2 | 11/2007 | Ellingsen, Jr. |
| 7,341,040 | B1 | 3/2008 | Wiesen |
| 7,360,531 | B2 | 4/2008 | Yohso |
| 7,452,191 | B2 | 11/2008 | Tell |
| 7,559,298 | B2 | 7/2009 | Cleeves |
| 7,576,353 | B2 | 8/2009 | Diduck |
| 7,584,820 | B2 | 9/2009 | Parker |
| 7,628,606 | B1 | 12/2009 | Browning |
| 7,634,980 | B2 | 12/2009 | Jarnland |
| 7,717,701 | B2 | 5/2010 | D'Agostini |
| 7,810,479 | B2 | 10/2010 | Naquin |
| 7,900,454 | B2 | 3/2011 | Schoell |
| 7,984,684 | B2 | 7/2011 | Hinderks |

(56) References Cited

U.S. PATENT DOCUMENTS

| | | | |
|---|---|---|---|
| 8,037,862 | B1 | 10/2011 | Jacobs |
| 8,215,292 | B2 | 7/2012 | Bryant |
| 8,251,040 | B2 | 8/2012 | Jang |
| 8,284,977 | B2 | 10/2012 | Ong |
| 8,347,843 | B1 | 1/2013 | Batiz-Vergara |
| 8,385,568 | B2 | 2/2013 | Goel |
| 8,479,871 | B2 | 7/2013 | Stewart |
| 8,640,669 | B2 | 2/2014 | Nakazawa |
| 8,656,870 | B2 | 2/2014 | Surnilla |
| 8,714,135 | B2 | 5/2014 | Anderson |
| 8,776,759 | B2 | 7/2014 | Cruz |
| 8,800,527 | B2 | 8/2014 | McAlister |
| 8,827,176 | B2 | 9/2014 | Browning |
| 8,857,405 | B2 | 10/2014 | Attard |
| 8,863,724 | B2 | 10/2014 | Shkolnik |
| 8,919,321 | B2 | 12/2014 | Burgess |
| 9,175,736 | B2 | 11/2015 | Greuel |
| 9,289,874 | B1 | 3/2016 | Sabo |
| 9,309,807 | B2 | 4/2016 | Burton |
| 9,441,573 | B1 | 9/2016 | Sergin |
| 9,512,779 | B2 | 12/2016 | Redon |
| 9,736,585 | B2 | 8/2017 | Pattok |
| 9,739,382 | B2 | 8/2017 | Laird |
| 9,822,968 | B2 | 11/2017 | Tamura |
| 9,854,353 | B2 | 12/2017 | Wang |
| 9,938,927 | B2 | 4/2018 | Ando |
| 2002/0114484 | A1 | 8/2002 | Crisco |
| 2002/0140101 | A1 | 10/2002 | Yang |
| 2003/0111122 | A1 | 6/2003 | Horton |
| 2005/0036896 | A1 | 2/2005 | Navarro |
| 2005/0087166 | A1 | 4/2005 | Rein |
| 2005/0155645 | A1 | 7/2005 | Freudendahl |
| 2005/0257837 | A1 | 11/2005 | Bailey |
| 2006/0230764 | A1 | 10/2006 | Schmotolocha |
| 2007/0039584 | A1 | 2/2007 | Ellingsen, Jr. |
| 2007/0101967 | A1 | 5/2007 | Pegg |
| 2008/0169150 | A1 | 7/2008 | Kuo |
| 2008/0184878 | A1 | 8/2008 | Chen |
| 2008/0185062 | A1 | 8/2008 | Nijland |
| 2010/0071640 | A1 | 3/2010 | Mustafa |
| 2011/0030646 | A1 | 2/2011 | Barry |
| 2011/0132309 | A1 | 6/2011 | Turner |
| 2011/0139114 | A1 | 6/2011 | Nakazawa |
| 2011/0235845 | A1 | 9/2011 | Wang |
| 2012/0103302 | A1 | 5/2012 | Attard |
| 2012/0114148 | A1 | 5/2012 | Goh Kong San |
| 2012/0186561 | A1 | 7/2012 | Bethel |
| 2013/0036999 | A1 | 2/2013 | Levy |
| 2013/0327039 | A1 | 12/2013 | Schenker et al. |
| 2014/0056747 | A1 | 2/2014 | Kim |
| 2014/0109864 | A1 | 4/2014 | Drachko |
| 2014/0199837 | A1 | 7/2014 | Hung |
| 2014/0361375 | A1 | 12/2014 | Deniz |
| 2015/0059718 | A1 | 3/2015 | Claywell |
| 2015/0153040 | A1 | 6/2015 | Rivera Garza |
| 2015/0167536 | A1 | 6/2015 | Toda et al. |
| 2015/0184612 | A1 | 7/2015 | Takada et al. |
| 2015/0337878 | A1 | 11/2015 | Schlosser |
| 2015/0354570 | A1 | 12/2015 | Karoliussen |
| 2016/0017839 | A1 | 1/2016 | Johnson |
| 2016/0064518 | A1 | 3/2016 | Liu |
| 2016/0258347 | A1 | 9/2016 | Riley |
| 2016/0265416 | A1 | 9/2016 | Ge |
| 2016/0348611 | A1 | 12/2016 | Suda et al. |
| 2016/0348659 | A1 | 12/2016 | Pinkerton |
| 2016/0356216 | A1 | 12/2016 | Klyza |
| 2017/0248099 | A1 | 8/2017 | Wagner |
| 2017/0260725 | A1 | 9/2017 | McAlpine |
| 2018/0096934 | A1 | 4/2018 | Siew |
| 2018/0130704 | A1 | 5/2018 | Li |

FOREIGN PATENT DOCUMENTS

| | | |
|---|---|---|
| CN | 206131961 | 4/2017 |
| DE | 19724225 | 12/1998 |
| EP | 0025831 | 4/1981 |
| EP | 2574796 | 4/2013 |
| FR | 1408306 | 8/1965 |
| FR | 2714473 | 6/1995 |
| GB | 104331 | 1/1918 |
| GB | 139271 | 3/1920 |
| GB | 475179 | 11/1937 |
| GB | 854135 | 11/1960 |
| GB | 1437340 | 5/1976 |
| GB | 1504279 | 3/1978 |
| GB | 1511538 | 5/1978 |
| GB | 2140870 | 12/1984 |
| JP | S5377346 | 7/1978 |
| JP | S5833393 | 2/1983 |
| JP | 58170840 | 10/1983 |
| JP | S5973618 | 4/1984 |
| JP | H02211357 | 8/1990 |
| JP | H0638288 | 5/1994 |
| JP | 2000064905 | 3/2000 |
| JP | 2003065013 | 3/2003 |
| JP | 5535695 | 7/2014 |
| TW | 201221753 | 6/2012 |
| WO | 1983001485 | 4/1983 |
| WO | 2006046027 | 5/2006 |
| WO | 2007065976 | 6/2007 |
| WO | 2010118518 | 10/2010 |
| WO | 2016145247 | 9/2016 |

OTHER PUBLICATIONS

International Searching Authority Search Report and Written Opinion for application PCT/US2018/024102, dated Jun. 25, 2018, 10 pages.

International Searching Authority Search Report and Written Opinion for application PCT/US2018/024477, dated Jul. 20, 2018, 14 pages.

International Searching Authority Search Report and Written Opinion for application PCT/US2018/024485, dated Jun. 25, 2018, 16 pages.

International Searching Authority Search Report and Written Opinion for application PCT/US2018/024844, dated Jun. 8, 2018, 9 pages.

International Searching Authority Search Report and Written Opinion for application PCT/US2018/024852, dated Jun. 21, 2018, 9 pages.

International Searching Authority Search Report and Written Opinion for application PCT/US2018/025133, dated Jun. 28, 2018, 9 pages.

International Searching Authority Search Report and Written Opinion for application PCT/US2018/025151, dated Jun. 25, 2018, 14 pages.

International Searching Authority Search Report and Written Opinion for application PCT/US2018/025471, dated Jun. 21, 2018, 10 pages.

International Searching Authority Search Report and Written Opinion for application PCT/US2018/029947, dated Jul. 26, 2018, 12 pages.

International Searching Authority Search Report and Written Opinion for application PCT/US2018/030937, dated Jul. 9, 2018, 7 pages.

International Searching Authority Search Report and Written Opinion for application PCT/US2018/053264, dated Dec. 3, 2018, 10 pages.

International Searching Authority Search Report and Written Opinion for application PCT/US2018/053350, dated Dec. 4, 2018, 7 pages.

International Searching Authority Search Report and Written Opinion for application PCT/US2019/014936, dated Apr. 18, 2019, 9 pages.

International Searching Authority Search Report and Written Opinion for application PCT/US2019/015189, dated Mar. 25, 2019, 10 pages.

Keller, L. E., "Application of Trunk Piston Labyrinth Compressors in Refrigeration and Heat Pump Cycles" (1992). International Compressor Engineering Conference. Paper 859. http://docs.lib.purdue.edu/icec/859.

(56) References Cited

OTHER PUBLICATIONS

Quasiturbine Agence, "Theory—Quasiturbine Concept" [online], Mar. 5, 2005 (Mar. 5, 2005), retrieved from the internet on Jun. 28, 2018) URL:http://quasiturbine.promci.qc.ca/ETheoryQTConcept.htm; entire document.

Vetter, H., "The Sulzer Oil-Free Labyrinth Piston Compressor" (1972). International Compressor Engineering Conference. Paper 33. http://docs.lib.purdue.edu/icec/33.

AUDIO SOURCE WAVEGUIDE

CROSS REFERENCE TO RELATED APPLICATIONS

This application relates to and claims the priority of U.S. Provisional Patent Application No. 62/622,645, which was filed Jan. 26, 2018.

FIELD OF THE INVENTION

Embodiments of the present invention relate generally to apparatus for affecting air flow and/or pressure wave propagation in relation to an audio source enclosure.

BACKGROUND OF THE INVENTION

Many devices, systems and processes utilize the flow of a working fluid, such as air for example, between two locations relative to a structure. Flow of a working fluid may occur in concert with the propagation of pressure waves in the working fluid. The desired flow of the working fluid and/or propagation of pressure waves can be inhibited by the interaction of the structure with the working fluid. For example, frictional forces between the structure and the working fluid may impart a drag force on the working fluid. The efficient and controlled operation of devices, systems and processes that require a working fluid to flow in proximity to a structure may be improved by generating a stratified stream of working fluid. A stratified stream may provide improved flow of a working fluid and/or propagation of pressure waves for numerous applications such as, but not limited to, loudspeakers, musical instruments, and other audio sources.

With regard to loudspeakers, the structure that interacts with the working fluid is typically an enclosure. The loudspeaker enclosure may have one or more speakers mounted in openings. In one example type of loudspeaker, the speakers may each comprise a front cone flexibly sealed to the enclosure, and a rear magnet and windings that drive the cone forward and back in an oscillating motion to produce pressure waves in the air. The pressure waves emanating from the outside of the speaker cone travel from the front of the speaker through the air to the listener's ear where the pressure waves are detected as sound. The pressure waves generated by the backside of the speaker propagate within the enclosure, and depending upon the enclosure design, may negatively affect the overall sound that reaches the listener.

In order to limit the negative impact of pressure waves generated inside the enclosure on the sound reaching the listener, the loudspeaker enclosure may also include one or more vent ports providing fluid (air) communication between the interior of the enclosure and the ambient environment surrounding the loudspeaker. A vent port permits the flow of air into and out of the interior of the enclosure in response to the pressure waves generated by the inside surface of the oscillating speaker cone in the enclosure interior. The location, shape and size of such vent ports can influence the operation of the loudspeaker and the sound produced.

The inclusion of ports in audio sources is not limited to loudspeakers. Some musical instruments also include an enclosure with a port designed to produce an audio effect. For example, the opening or port in a guitar body permits pressure waves to travel between the body interior and the ambient environment. The reverberation of these pressure waves produces a distinct "guitar" sound in response to the vibration of strings in proximity to the opening in the guitar body. The location, shape and size of the guitar opening, among other things, can affect the characteristics of the sound it generates.

The transmission of pressure waves to and from an audio source port, and/or the flow of air through the port may be affected by the inclusion of one or more shaped surfaces to guide the pressure waves, and/or flow of air, in and out of the enclosure. In particular, one or more shaped surfaces may be provided to encourage a stratified stream air flow through a port in an audio source enclosure. The inclusion of one or more shaped surfaces to encourage a stratified stream air flow in an audio source may provide additional advantages. For example, shaped surfaces configured to produce stratified stream air flow may result in an overall design with improved acoustic and aesthetic characteristics, as well as a smaller enclosure for a given acoustic output. Use of shaped surfaces to produce a stratified stream may also permit a vent port to be located on the same side of the enclosure as the speaker cone or in the center of the speaker cone, or to extend between opposing sides of the enclosure.

OBJECTS OF THE INVENTION

Accordingly, it is an object of some, but not necessarily all, embodiments of the present invention to influence the transmission of pressure waves in an audio source.

It is a further object of some, but not necessarily all, embodiments of the present invention to influence the transmission of pressure waves emanating from an audio source.

It is a still a further object of some, but not necessarily all, embodiments of the present invention to improve the quality of sound produced by an audio source.

It is a still further object of some, but not necessarily all, embodiments of the present invention to improve the flow of air through a port provided in an audio source enclosure.

It is a still further object of some, but not necessarily all, embodiments of the present invention to produce a stratified stream air flow through a port provided in an audio source enclosure.

It is a still further object of some, but not necessarily all, embodiments of the present invention to permit the port in an audio source enclosure to be positioned in a location that provides acoustic and/or aesthetic advantages relative to known port locations.

It is a still further object of some, but not necessarily all, embodiments of the present invention to utilize a smaller audio source enclosure relative to the size of past enclosures having similar acoustic characteristics.

It is a still further object of some, but not necessarily all, embodiments of the present invention to permit a port in an audio source enclosure to be positioned on the same face of the enclosure as a speaker cone.

It is a still further object of some, but not necessarily all, embodiments of the present invention to permit a port in an audio source enclosure that extends between opposing sides of the enclosure.

It is a still further object of some, but not necessarily all, embodiments of the present invention to permit a port in an audio source enclosure to be located in the center of a speaker cone.

These and other advantages of some, but not necessarily all, embodiments of the present invention will be apparent to those of ordinary skill in the art.

SUMMARY OF EMBODIMENTS OF THE INVENTION

Responsive to the foregoing challenges, Applicant has developed an innovative audio source comprising: an enclosure generally defining an enclosure interior and an enclosure exterior, said enclosure having a first opening extending between the enclosure interior and enclosure exterior; a first waveguide section including a first passage in fluid communication with a first hollow portion of a first funnel, said first funnel including a first surface generally flaring away from the first passage between a first funnel end and a first funnel tip; and a second waveguide section including a second passage in fluid communication with a second hollow portion of a second funnel, said second funnel including a second surface generally flaring away from the second passage between a junction of the second passage with the second funnel and a second funnel end, wherein one or both of the first waveguide section and the second waveguide section extend from the first opening, wherein the first funnel end is disposed within the second hollow portion, and wherein an air flow path extends from the enclosure interior through a space between the first funnel first surface and the second funnel second surface to the first passage and the second passage.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF EMBODIMENTS OF THE INVENTION

Figure 1:
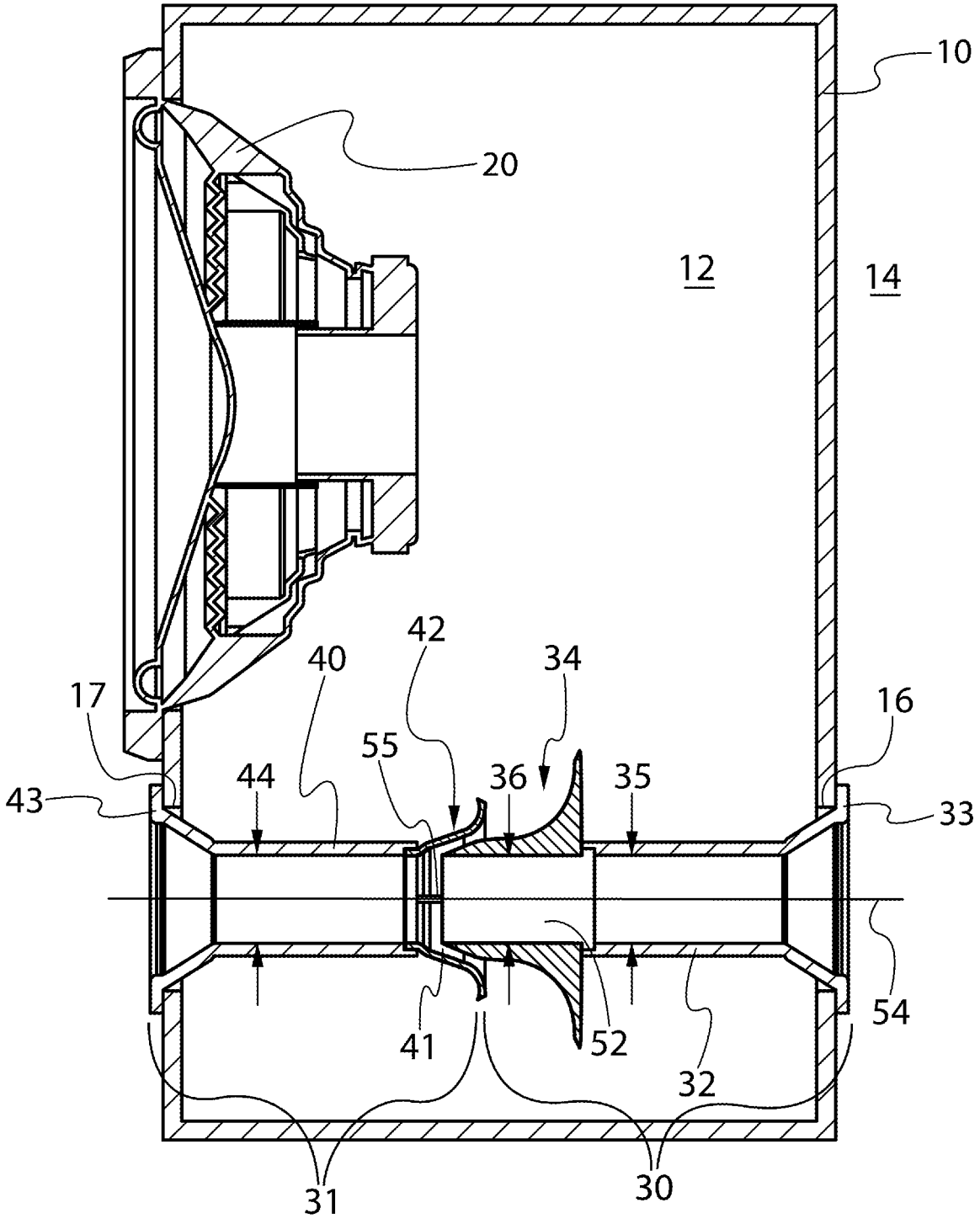
FIG. 1 is a side cross-sectional view of a first loudspeaker embodiment of the present invention.

Reference will now be made in detail to embodiments of the present invention, examples of which are illustrated in the accompanying drawings. With reference to FIG. 1, a first loudspeaker embodiment may include an enclosure 10 separating an enclosure interior 12 from an enclosure exterior 14. The enclosure 10 may have any number of overall shapes, such as but not limited to a generally cuboid, pyramidal, ellipsoid, conical or other three-dimensional shape. Multiple openings may extend through the wall of the enclosure 10 providing communication between the enclosure interior 12 and the enclosure exterior 14. For example, a speaker opening may be provided in the enclosure 10 to accommodate a speaker 20 flexibly mounted to the enclosure. Additional speaker openings may be provided in the enclosure 10 for additional speakers depending upon the particular loudspeaker requirements.

Still other openings may be provided in the enclosure 10 for waveguide elements. Specifically, a first waveguide opening 16 and a second waveguide opening 17 may each extend between the enclosure interior 12 and enclosure exterior 14 to accommodate waveguide elements. The first waveguide opening 16 and the second waveguide opening 17 may be disposed on opposed surfaces of the enclosure 10, and may share a common central axis 54. The first and second waveguide openings 16 and 17 may have generally circular shapes of like size formed in the walls of the enclosure 10. It is appreciated, however, that the first and second waveguide openings 16 and 17 may have non-circular shapes, may be of non-like shape, may be of non-like size, may not be on opposed surfaces of the enclosure 10, and/or may not share a common central axis, in alternative embodiments.

Figure 2:
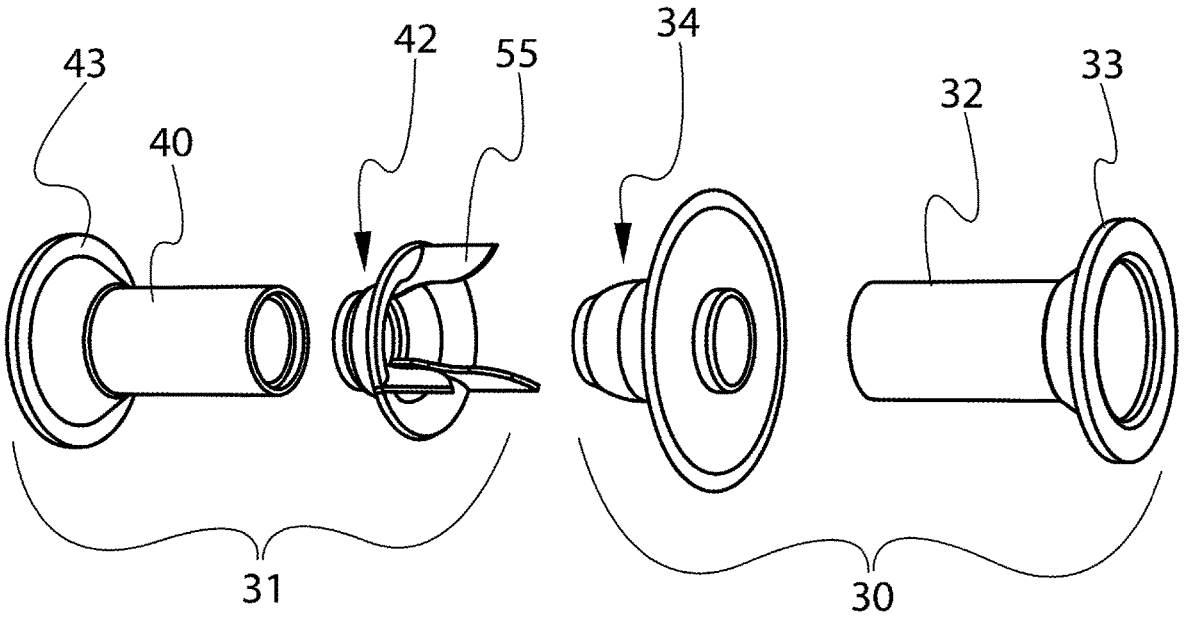
FIG. 2 is an exploded isometric view of the waveguide embodiment shown in FIG. 1.

With reference to FIGS. 1 and 2, a first waveguide section 30 may extend from or through the first waveguide opening 16 into the enclosure interior 12 towards the second waveguide opening 17. In this embodiment, the first waveguide section 30 may extend from an enclosure 10 wall that is opposite the wall in which the speaker 20 is mounted, and the second waveguide section 31 may extend from the same enclosure wall in which the speaker is mounted. The first waveguide section 30 may be characterized generally as a hollow tube including a first passage 32 extending between a first end 33 and a first funnel 34. Similarly, a second waveguide section 31 may extend from or through the second waveguide opening 17 into the enclosure interior 12 towards the first wave guide opening 16. The second waveguide section 31 also may be characterized generally as a hollow tube including a second passage 40 extending between a second end 43 and a second funnel 42. The various passages, openings and hollow portions of the first and second waveguide sections 30 and 31 may have circular cross-sections taken in a plane perpendicular to the cross-sectional plane of FIG. 1 and at a uniform right angle to the central axis 54.

With regard to the first waveguide section 30, the first end 33 may be connected to the enclosure 10 at the first waveguide opening 16 and may have a hollow interior that communicates with the enclosure exterior 14. The first end 33 may be flared, and when flared, the first end may be defined by a generally frusto-conical wall defining a hollow interior that is widest near the first waveguide opening 16 and narrowest at the junction of the first end 33 with the first passage 32. It is appreciated that in alternative embodiments of the invention, the first end 33 may not be flared and/or may include a cover (see FIG. 10) blocking, guiding, and/or restricting communication between the hollow interior of the first end of the first waveguide section 30 at the enclosure exterior 14. Such covers may include, but not be limited to, what are known as passive radiators.

The hollow interior of the first waveguide section 30 first end 33 may communicate with and connect to the first passage 32. The first passage 32 may include a tube wall surrounding a hollow interior. The first passage 32 may have a common center axis 54 with the first end 33. The first passage 32 may have a cross-sectional dimension or diameter 35 that is relatively uniform in the direction extending along the central axis 54 between the first end 33 and the first funnel 34. The first passage 32 may extend into the enclosure interior 12 a sufficient distance to locate the first funnel 34 at or near a midpoint between the first and second waveguide openings 16 and 17. However, in alternative embodiments, the first funnel 34 may be located near or along an enclosure 10 surface.

Figure 3:
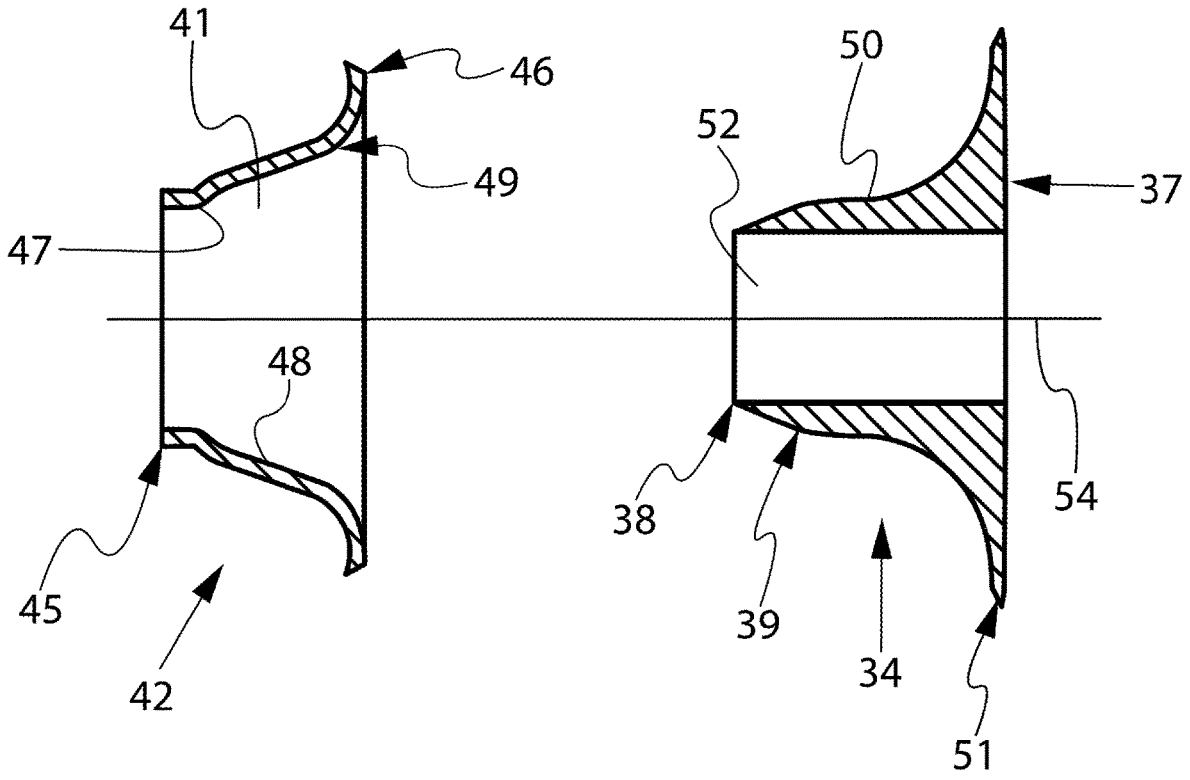
FIG. 3 is a cross-sectional exploded view of portions of the waveguide embodiment shown in FIGS. 1 and 2.

With reference to FIGS. 1, 2 and 3, the first passage 32 may connect to the first funnel 34 and the hollow interior of the first passage may communicate with a hollow portion 52 of the first funnel. The hollow portion 52 of the first funnel 34 may extend from the first passage 32 to a first funnel end 38, and may have a common central axis 54 with the first end 33 and the first passage 32. The cross-sectional dimension or diameter 36 of the hollow portion 52 of the first funnel 34 may be relatively uniform in the direction it extends along the central axis 54, and may have substantially the same cross-sectional dimension as the first passage 32. The first funnel 34 may include a wall 50 defining on the inside, the shape and size of the hollow portion 52. Starting from the first funnel end 38, the first funnel wall 50 may include a first surface 39 that generally flares away from the first axis 54 in a direction towards the first passage 32. The first surface 39 may have a compound curvature between the first funnel end 38 and a first funnel tip 51. The compound curved first surface 39 may first approach being co-planar with a first reference plane that is parallel to the central axis 54 and then progressively curve away from the first reference plane and approach being co-planar with a second reference plane set at a right angle to the central axis. The end of the first funnel 34 distal from the first funnel end 38 may include a generally flat face 37 extending in a plane between the first funnel tip 51 and the hollow portion 52. The face 37 may be set at a right angle relative to the first passage 32. In alternative embodiments, the face 37 of the first funnel 34 may be located near or adjacent to an enclosure 10 surface.

With renewed reference to FIGS. 1 and 2, and with regard to the second waveguide section 31, the second end 43 may be connected to the enclosure 10 at the second waveguide opening 17 and may have a hollow interior that communicates with the enclosure exterior 14. The second end 43 may have a common central axis 54 with one or more elements of the first waveguide section 30. The second end 43 may be flared, and when flared, the second end may include a generally frusto-conical wall that defines a hollow interior that is widest near the second waveguide opening 17 and narrowest at the junction of the second end 43 with the second passage 40. It is appreciated that in alternative embodiments of the invention, the second end 43 may not be flared and/or may include a cover (see FIG. 10) blocking, guiding, and/or restricting communication between the hollow interior of the second end at the enclosure exterior 14. Such covers may include, but not be limited to, what are known as passive radiators.

The hollow interior of the second end 43 of the second waveguide section 31 may connect to the second passage 40 and the hollow interior of the second end may communicate with the second passage. The second passage 40 may be defined generally by a tube wall surrounding a hollow interior, and may have a common central axis 54 with the second end 43 and one or more elements of the first waveguide section 30. The second passage 40 may have a cross-sectional dimension or diameter 44 that is relatively uniform in the direction extending along the central axis 54 between the second end 43 and the second funnel 42. The second passage 40 may extend into the enclosure interior 12 a sufficient distance to locate the second funnel 42 at or near a midpoint between the first and second waveguide openings 16 and 17. However, in alternative embodiments, the second funnel 42 may be located near an enclosure 10 surface if the first funnel 34 is located near or along the enclosure surface.

With renewed reference to FIGS. 1, 2 and 3, the second passage 40 may connect to the second funnel 42 and the hollow interior of the second passage may communicate with a hollow portion 41 of the second funnel. The second funnel 42 may include a wall 48 defining, on the inside, the shape and size of the hollow portion 41. The hollow portion 41 of the second funnel 42 may extend from a first end 45 connected to the second passage 40 to a second funnel end 46, and may have a common central axis 54 with the second end 43 and the second passage. Starting from a point 47 slightly spaced from the second passage 40, the second funnel wall 48 may include a bell-shaped second surface 49 generally flaring away from the second axis 54 in the direction of the second funnel end 46. Thus, the cross-sectional dimension or diameter of the hollow portion 41 of the second funnel 42 may be non-uniform along the central axis 54. The cross-sectional dimension of the first end 45 of the hollow portion 41 may be substantially the same as that of the second passage 40 hollow interior. The second surface 49 may have a compound curvature between the first end 45 and the second funnel end 46, similar to that of the first surface 39. It is appreciated that the various passages, openings and hollow portions of the first and second waveguide sections 30 and 31 may have non-circular cross-sections, may be of non-like shape, may be of non-like size, may not be on opposed surfaces of the enclosure 10, and/or may not share a common central axis, in alternative embodiments.

The curvature of the second surface 49 of the second funnel 42 may be complementary to that of the first surface 39 of the first funnel 34. The shapes and sizes of the first funnel 34 and the second funnel 42 are preferably not identical, however. As shown in FIGS. 1-3, the first funnel 34 first surface 39 may extend farther away from the central axis 54 than the second surface 49 of the second funnel 42. In other words, the tip 51 of the first funnel 34 may be located farther away from the central axis 54 than the second funnel end 46. In the non-limiting example shown in FIG. 1, the tip 51 may be located more than about 1.3 times as far from the central axis 54 than the second funnel end 46. Additionally, the first surface 39 may extend in the direction of the central axis 54 a greater distance than the second surface 49 extends in this direction. In the non-limiting example shown in FIG. 1, the first surface 39 may extend more than about 1.5 times as far as the second surface 49 in the direction of the central axis 54. Still further, the curvatures of first surface 39 near the tip 51 and the second surface 49 near the second funnel end 46 may smoothly approach being tangent to planes perpendicular to the central axis 54, as shown in FIGS. 1-3.

With continued reference to FIGS. 1-3, the lengths of the first passage 32 and the second passage 40 also may be selected to space the complementary surfaces of the first funnel 34 and the second funnel 42 apart in a nesting relationship wherein the first funnel end 38 is disposed within the second funnel 42 hollow portion 41. The first funnel 34 and the second funnel 42 may be spaced from one another by one or more optional guide fins 55. The one or more guide fins 55 may be part of the first funnel 34 or the second funnel 42; or the guide fins may be provided as separate elements.

The nesting complementary relationship of the first funnel 34 and the second funnel 42 may form a narrowing curved circumferential air flow path extending from the enclosure interior 12 through a space between the first funnel and the second funnel. Specifically, the air flow path may extend between the first surface 39 of the first funnel 34 and the second surface 49 of the second funnel 42 to the hollow interior 52 of the first funnel 34 and the hollow interior of the second passage 40. In the non-limiting example shown in FIGS. 1-3, the air flow path between the first surface 39 and the second surface 49 may intersect the hollow interiors of the first passage 32 and the second passage 40 at an angle of attack of between about 20 to 40 degrees from the central axis 54.

References herein to air flow, air flow paths, air flow streams, and the like, between two points in space should be understood to not require that the same air particle (e.g. molecule or atom) travel between the two points. For example, air flows, flow paths, and flow streams may be established when a pressure wave in the air medium propagates or travels between two points. While a particular air particle also may travel between such points as a result of use of various embodiments of the invention, it is not required to do so for an air flow, flow path, flow stream, or the like to exist.

With continued reference to FIGS. 1-3, the air flow between the first surface 39 of the first funnel 34 and the second surface 49 of the second funnel 42 to the hollow interior of the first passage 32 and the hollow interior of the second passage 40 may be bi-directional. The shapes of the first surface 39 and the second surface 49 may be selected to provide stratified stream air flow out of the enclosure 10 to the enclosure exterior 14 in particular. When the loudspeaker is provided with appropriate electrical connections, powered, and connected with an audio signal producing element the speaker 20 cone may translate in and out relative to the enclosure 10. As the cone of the speaker 20 moves backward, it may create a compression pressure wave that is reflected off the back wall of the enclosure 10 and guided into the air flow space between the first funnel 34 and the second funnel 42. An attendant Coanda effect and Venturi effect may cause the speaker generated pressure wave to exit the air flow space at an angle as it enters the injection area between the second passage 40 and the hollow portion 52. This in turn may set up vortex rings on either side of the injection area in the second passage 40 and the hollow portion 52. These vortex rings may take on a toroidal shape and may tend to cling to the walls of the second passage 40 and the hollow portion 52.

The vortex ring in the second passage 40 may tend to focus the air stream by internally providing a virtual focusing surface. This also may reduce drag as the air is shaped and may tend to accelerate the air stream, allowing it to reach a higher linear velocity while imparting a small amount of helically shaped toroidal spin to the stream. The focal distance of the second passage 40 air stream may be based upon lines tangent to curves of the first surface 39 and the second surface 49. The air flow stream in the second passage 40 also may be accelerated due to the lower surface drag near the walls of the second passage. The air flow stream in the second passage 40 may also tend to refocus after emerging from the second end 43 into the enclosure exterior 14 due to the small amount of imparted spin in the outer flow of the stream. This external refocusing action may allow a more tightly focused reinforcement pressure wave, which can be advantageous if the loudspeaker is placed near an appropriately dampened reflective surface, such as a floor or a wall.

With continued reference to the flow of air out of the enclosure 10 to the exterior 14, a relatively weaker stratified air stream may pass through the hollow portion 52 of the first funnel 34, the first passage 32 and the first end 33 to the exterior 14. The air stream to the first end 33 may pass through and be compressed by the center of the vortex toroidal ring in the hollow portion 52. This air stream may tend to be slower moving and have less volume than the air stream passing through the second passage 40. When the air stream emerges from the flared first end 33, it may tend to curve toward or away from the loudspeaker due to the pressure waves created by the speaker during movement. Based on the estimated length of wave travel and the desired reinforcement frequency or frequencies, the lengths and diameters of the first passage 32 and the second passage 40 may be selected to keep the waves in acceptable phase. If the phase of the waves is not acceptable, the tube lengths and/or diameters can be modified to correct them. It may also be useful to add sound wave propagation modifying materials to the inside of the enclosure 10, and/or the first and second ends 33 and 43. Such materials may include poly fill, foam, fiberglass, felt, rubber, asphalt, urethane, and the like. It may also be necessary to add wave directing or shaping features within the enclosure 10 to stiffen the enclosure and/or to reduce unwanted turbulence within the corners of the enclosure.

The dynamic behavior of the stratified streams may be determined for the inflection points of the speaker 20 travel. The toroidal rings may tend to spin in different directions, dependent upon on the direction of the compression wave and air flow. As an example, the transition period while the speaker is moving forward after completing a backward motion can be examined. Backward movement of the speaker may create a clockwise poloidal flow in the toroidal ring in the second funnel 42. It may also create a weaker counter-clockwise poloidal air flow in the toroidal ring near the internal stream focal point in the first funnel 34. As the speaker movement changes direction, the compression wave and air flow may reverse direction. During this reversal time, the toroidal rings may tend to maintain their coherence and resist the air flow change direction within the first and second ends 33 and 43. As this coherence decreases, the air flow may increase and create new toroidal rings with opposite spin poloidal flows.

The toroidal rings in the air flows may act like lagging inductive elements in an analogous electric arrangement which tend to filter higher frequency actions and allow lower frequency actions to pass. This action may be similar to that achieved by tuning traditional tunable ports, but with frequency rates which can be less gradual, much like a higher-order filter. This effect also may tend to make the enclosure behave more like a sealed enclosure for rapid events and more like a traditional ported enclosure for slower events.

Example audio sources configured to generate a stratified stream air flow may use the Venturi effect created by the decreasing diameter curved passage between the first and second funnels, and the Coanda effect at the junction of the space between the funnels and the first hollow portion in the first funnel and the second passage.

The creation of objectionable port noise, such as undesired resonant overtones, whistling, and supersonic speed induced noise is to be avoided. These concerns may be addressed by adding dampening mass to the enclosure and/or ports and passages. Dampening materials such as spray urethane or adhesive asphalt sheets may be used, or mass may be increased by manufacturing the waveguide sections from materials such as a fiber reinforced plastic. These concerns may also be addressed by adding dampening materials to the enclosure, such as open-cell polyfoam, floss, cloth, mesh, and/or similar materials to the enclosure and/or the passages and ports. Ideally, these concerns can also be addressed by modifying the passage geometries, changing the port flares, and/or including nozzle and nozzle-like structures in the passages.

Figure 4:
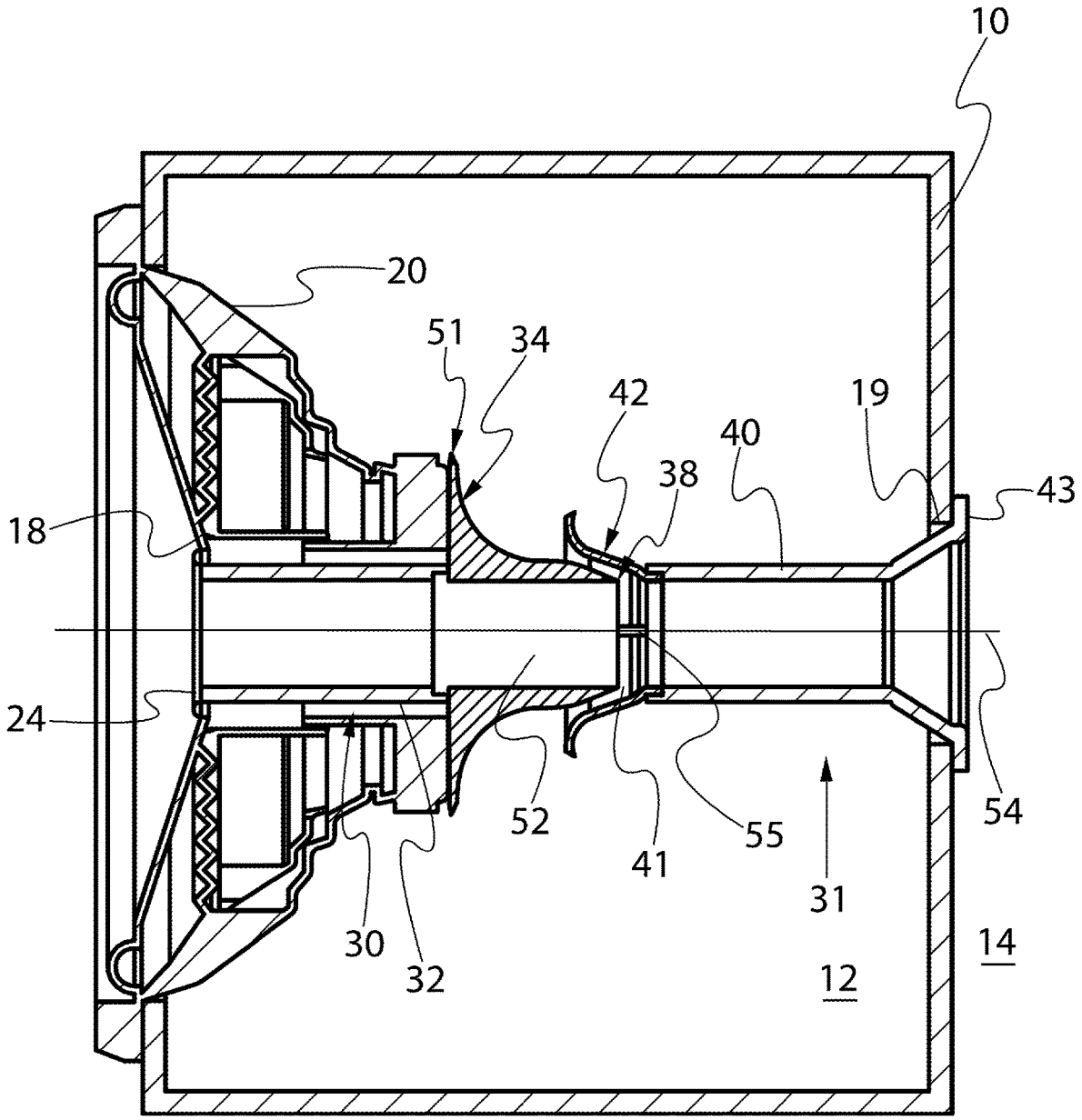
FIG. 4 is a side cross-sectional view of a second loudspeaker embodiment of the present invention.

A second loudspeaker embodiment of the present invention is illustrated in FIG. 4 in which like reference characters refer to like elements in the other drawing figures. With reference to FIG. 4, the description of the embodiment of the invention illustrated in FIGS. 1-3 is hereby incorporated by reference. Like in FIG. 1, the FIG. 4 loudspeaker may include an enclosure 10 generally defining an enclosure interior 12 and an enclosure exterior 14. The enclosure 10 may have any number of overall shapes, and may include multiple openings providing communication between the enclosure interior and the exterior. A speaker opening may be provided in the enclosure 10 to accommodate a speaker 20, and other openings 18 and 19 may be provided for waveguide elements.

Specifically, a first waveguide opening 18 may extend between the enclosure interior 12 and the enclosure exterior 14 through the center of the speaker 20. The first waveguide opening 18 may receive a first end 24 of the first waveguide section 30. A second waveguide opening 19 may extend between the enclosure interior 12 and enclosure exterior 14 to receive the second end 43 of the second waveguide section 31. The first waveguide opening 18 and the second waveguide opening 19 may be disposed on opposite sides of the enclosure 10, and may share a common central axis 54. The first and second waveguide openings 18 and 19 may have generally circular shapes of like size, however, they may have non-circular shapes, may be of non-like shape, may be of non-like size, may not be on opposite sides of the enclosure 10, and/or may not share a common central axis, in alternative embodiments.

The FIG. 4 first waveguide section 30 is similar to that of FIGS. 1-3, comprising a generally hollow tube including a first passage 32 extending between a first end 24 and a first funnel 34. The tip 51 of the first funnel 34 may be proximal to the speaker 20, and the first funnel end 38 may be distal from the speaker. The FIG. 4 second waveguide section 31 may be characterized generally as a hollow tube including a second passage 40 extending between a second end 43 and a second funnel 42. The various passages, openings and hollow portions of the first and second waveguide sections 30 and 31 may have circular cross-sections in a plane perpendicular to the cross-sectional plane of FIG. 4. The first funnel 34 may be firmly affixed at the inner end of the first passage 32 to the back of the speaker 20. The second funnel 42 may be firmly affixed to the first funnel 34 by one or more fins (see FIG. 3).

The shapes, sizes, and relative disposition of the first and second waveguide sections 30 and 31 in FIG. 4 are like those of FIGS. 1-3. The curvature of the second funnel 42 may be complementary to that of the first funnel 34. As in FIGS. 1-3, in the FIG. 4 embodiment, the lengths of the first passage 32 and the second passage 40 may be selected to space the complementary surfaces of the first funnel 34 and the second funnel 42 apart in a nesting relationship wherein the first funnel end 38 is disposed within the second funnel 42 hollow portion 41. The nesting complementary relationship of the first funnel 34 and the second funnel 42 may form a narrowing curved circumferential air flow path extending from the enclosure interior 12 through a space between the first funnel and the second funnel. Specifically, the air flow path may extend between the first funnel 34 and the second funnel 42 to the hollow interior 52 of the first funnel 34 and the hollow interior of the second passage 40.

The FIG. 4 embodiment may use a relatively smaller volume enclosure 10 than the FIG. 1 embodiment, which may provide greater pressure wave symmetry and air flow symmetry. The first waveguide opening 18 may be provided by eliminating or resizing a speaker 20 dust cap and connecting the first end 24 of the first waveguide section 32 through the open pole of the speaker. A surround may be attached between the waveguide opening 18 and the speaker cone similar to the attachment to the speaker frame, which allows the cone to move freely while providing an air seal.

The FIG. 4 embodiment may produce stronger stratified stream effects due to the flow having a more symmetrical and shorter path relative to the enclosure with less enclosure induced turbulence. As the speaker 20 moves backward, it may create a compression pressure wave in the enclosure interior 14 that is reflected off the back wall of the enclosure and guided into the centered decreasing diameter intake area between the first and second waveguide sections 30 and 31. Similar to the FIG. 1 embodiment, the FIG. 4 embodiment may use the Coanda effect and the Venturi effect to inject the speaker generated air pressure wave into the space between the first funnel 34 and the second funnel 42.

The FIG. 4 embodiment air flow streams through the first and second passages 32 and 40 may be of nearly equal strength. The air flow stream passing through the second passage 40 may be compressed by the center of a toroidal ring flow. The first passage 32 air flow stream may tend to be slightly slower moving and have less volume than the second passage 40 air flow stream, but there may be direct reinforcement from the low pressure area created at the first end 24 of the first passage due to the speaker 20 motion into the enclosure 10. When the air flow stream emerges from the first end 24, it may be centered within the speaker 20 and refocused by the waves from the speaker.

It should also be noted that the FIG. 4 embodiment loudspeaker may behave differently than the FIG. 1 embodiment when the speaker 20 is moving out of the enclosure interior 12 in the following regard. The location of the first end 24 within the speaker cone may result in a surrounding fluctuating pressure at the first end, and a low pressure area may occur at the first end in the middle of the speaker when the speaker 20 cone moves out of the enclosure 10. This low pressure area may cause air to be accelerated into the first passage 32 from the enclosure exterior 14. This acceleration may increase at increasing distances from the first end 24 (as measured from the exterior 14) and air may exit the second end 43 of the second waveguide section 31 with a similar reinforcing effect that is produced when the speaker 20 moves in the opposite direction. This may result in both speaker 20 movement directions having a pronounced rear port force wave directed away from the enclosure 10 at the second end 43 instead of an oscillating rear port force wave that may result from traditional port and speaker arrangements. This may make the rear port second end 43 behave more like an absolute value function of the speaker 20 movements with a direction vector always away from the enclosure 10.

Figure 5:
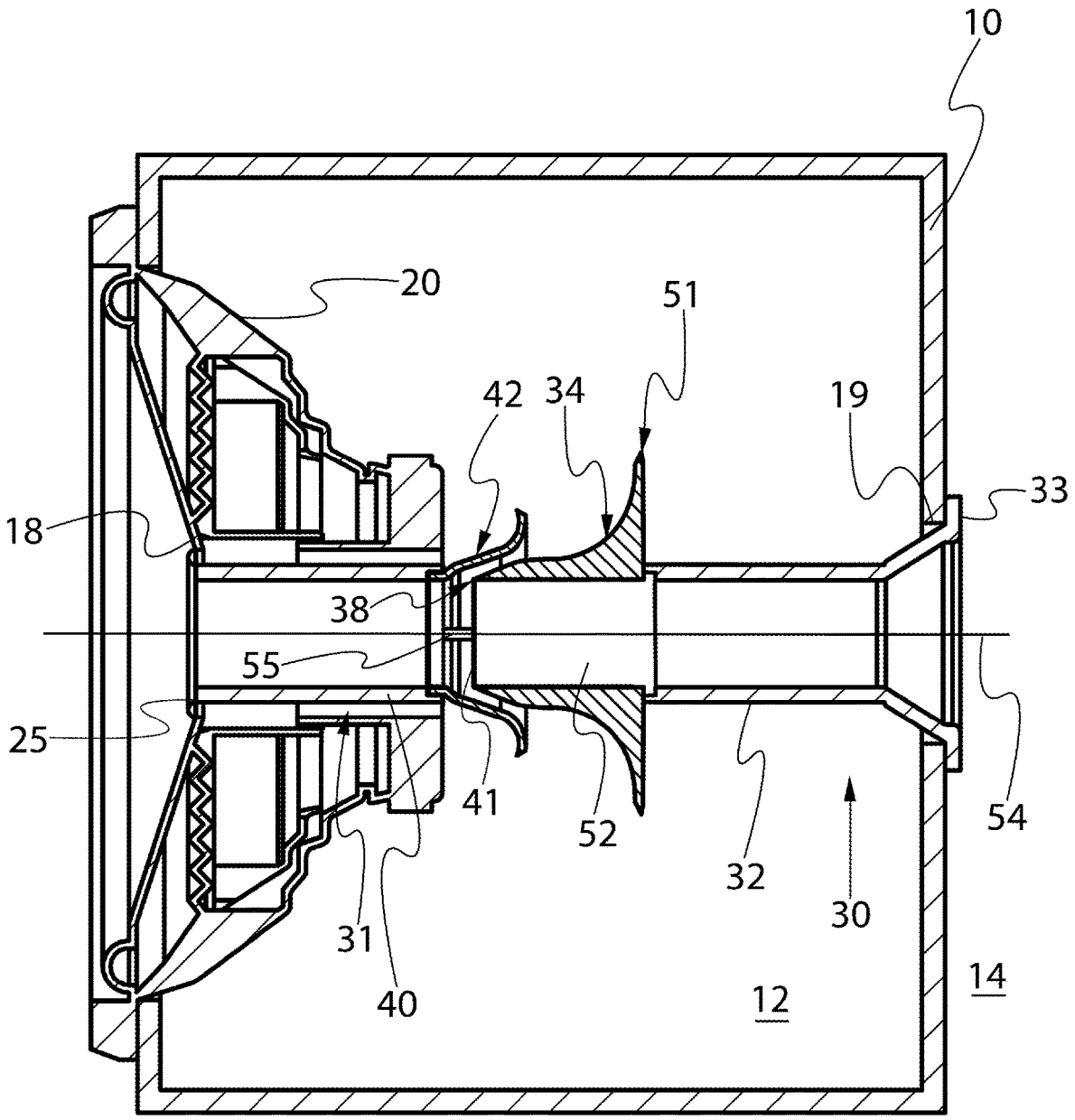
FIG. 5 is a side cross-sectional view of a third loudspeaker embodiment of the present invention.

FIG. 5, in which like reference characters refer to like elements, illustrates a third loudspeaker embodiment of the invention that is similar to that of FIG. 4. In the FIG. 5 embodiment, the locations of the first waveguide section 30 and the second waveguide section 31 are reversed as compared with the FIG. 4 embodiment. In other words, the first waveguide opening 18 may receive a second end 25 of the second waveguide section 31, and the second waveguide opening 19 may receive a first end 33 of the first waveguide section 30. As a result, the orientation of the first funnel 34 and the second funnel 42 relative to the speaker 20 in the FIG. 5 embodiment is reversed as compared with the FIG. 4 embodiment.

Figure 6:
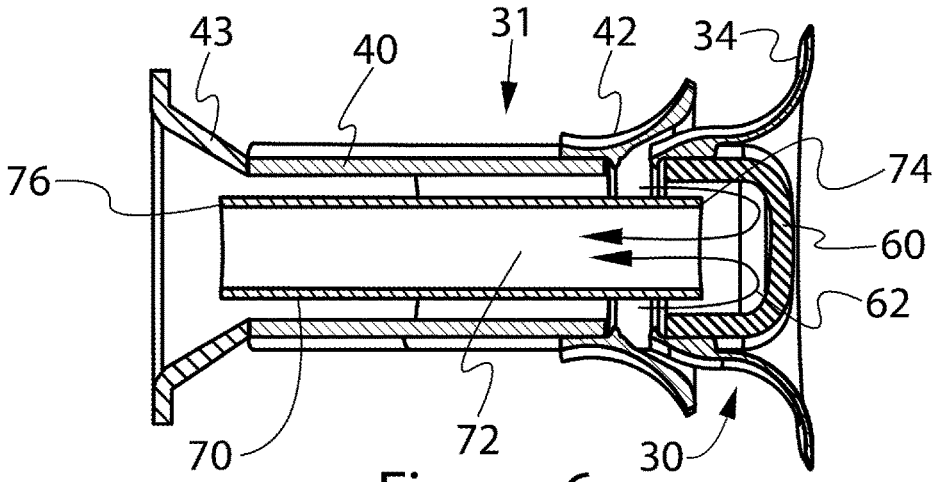
FIG. 6 is a side cross-sectional view of a first alternative waveguide embodiment of the present invention.

With reference to FIG. 6, in another embodiment of the invention the first waveguide section 30 may be disposed, in large measure, within the second waveguide section 31, and both waveguide sections may communicate with the enclosure exterior through a common opening. As shown in FIG. 6, the first waveguide section 30 may generally comprise a first passage 70 extending from a first passage first end 76 to a first passage second end 74. The first passage second end 74 may be connected to a first funnel 34. A second waveguide section 31 may generally comprise a second passage 40 surrounding the first passage 70 of the first waveguide section 30. The second passage 40 may extend from a second passage first end 43 to a second funnel 42. The various passages, openings and hollow portions of the first and second waveguide sections 30 and 31 may have circular cross-sections in a plane perpendicular to the cross-sectional plane of FIG. 6.

With regard to the first waveguide section 30, the first passage 70 may define a hollow interior 72, and the first passage may be suspended within the second passage 40 of the second waveguide section 31. The first passage 70 may communicate with the enclosure exterior and a first hollow portion 62 of the first funnel 34. The first hollow portion 62 may have an open end through which the first passage 70 extends so that the first passage second end 74 is suspended within the first hollow portion 62. An end wall 60 may block the flow of air through the end of the first funnel 34 opposite the open end. The end wall 60 may encourage the flow of air entering the open end of the first hollow portion 62 from the second waveguide section 30 to be redirected into the hollow interior 72 of the first passage 70 towards the enclosure exterior. The first funnel 34 may include a first surface that generally flares away from a central axis in the same manner as described in connection with FIGS. 1-5.

The second passage 40 first end 43 may be connected to the enclosure or the center of a speaker cone in the same manner as described in connection with FIGS. 1, 4 and 5. The second passage 40 may communicate with the enclosure exterior and a second hollow portion of the second funnel 42. The second funnel 42 may include a second surface that generally flares away from a central axis in the same manner as described in connection with FIGS. 1-5. The spacing and interrelation of the first surface of the first funnel 34 and the second surface of the second funnel for the FIG. 6 embodiment is like that of FIGS. 1-5.

Figure 7:
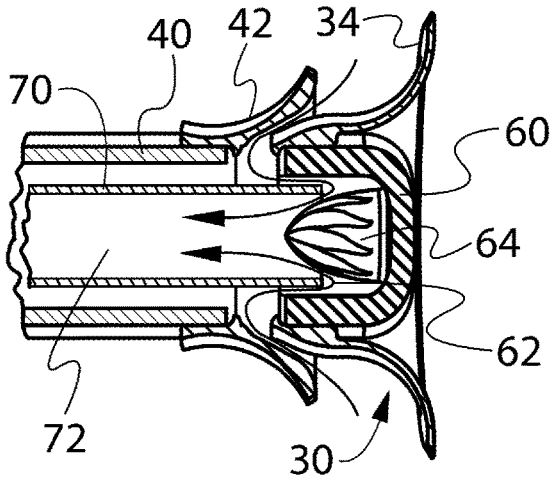
FIG. 7 is a side cross-sectional view of a second alternative waveguide embodiment of the present invention.

FIG. 7 illustrates another alternative embodiment which is like that of FIG. 6 with the addition of a generally bullet shaped air flow guide 64 extending from the end wall 60 into the first hollow portion 62 of the first funnel. The air flow guide 64 may include one or more channels formed in its surface to impart a swirling force on the air flow.

Figure 8:
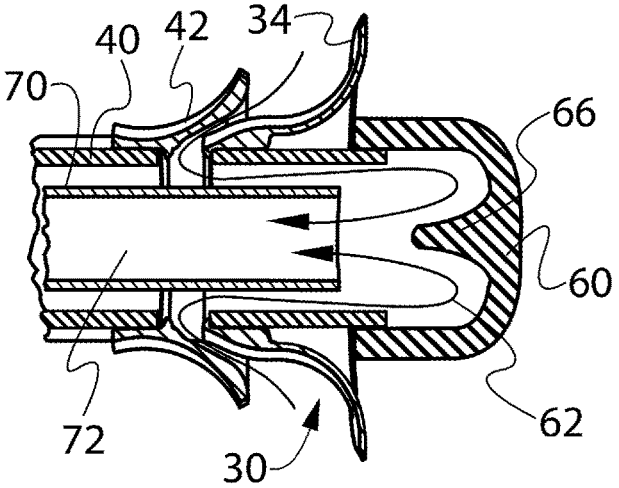
FIG. 8 is a side cross-sectional view of a third alternative waveguide embodiment of the present invention.

FIG. 8 illustrates still another alternative embodiment which is like that of FIGS. 6 and 7 with the following differences. In the FIG. 8 embodiment, the first hollow portion 62 may extend past a reference plane intersecting the outermost edge of the first funnel 34. The end wall 60 may include a concave walled central peak 66 extending towards the first hollow portion 62 of the first funnel.

Figure 9:
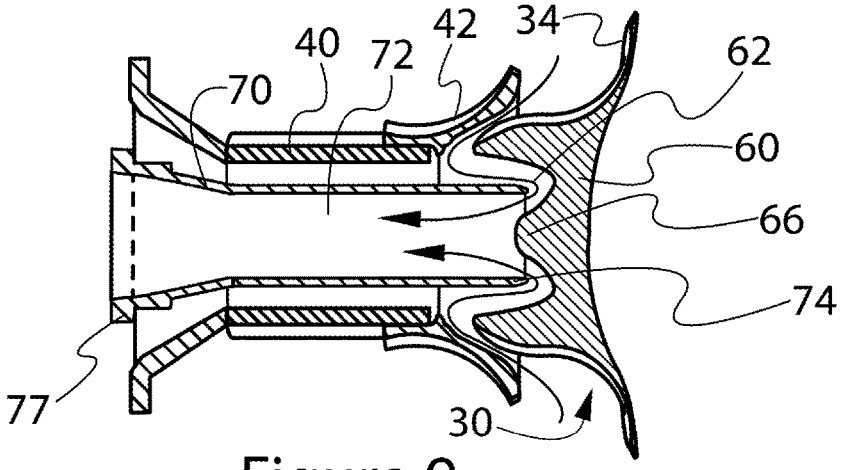
FIG. 9 is a side cross-sectional view of a fourth alternative waveguide embodiment of the present invention.

FIG. 9 illustrates another alternative embodiment which is like that of FIG. 8 with the following differences. In FIG. 9, the first hollow portion 62 does not extend past a reference plane intersecting the outermost edge of the first funnel 34. Further, the end wall 60 may include a concave walled central peak 66 that extends past the second end 74 of the first passage 70.

Figure 10:
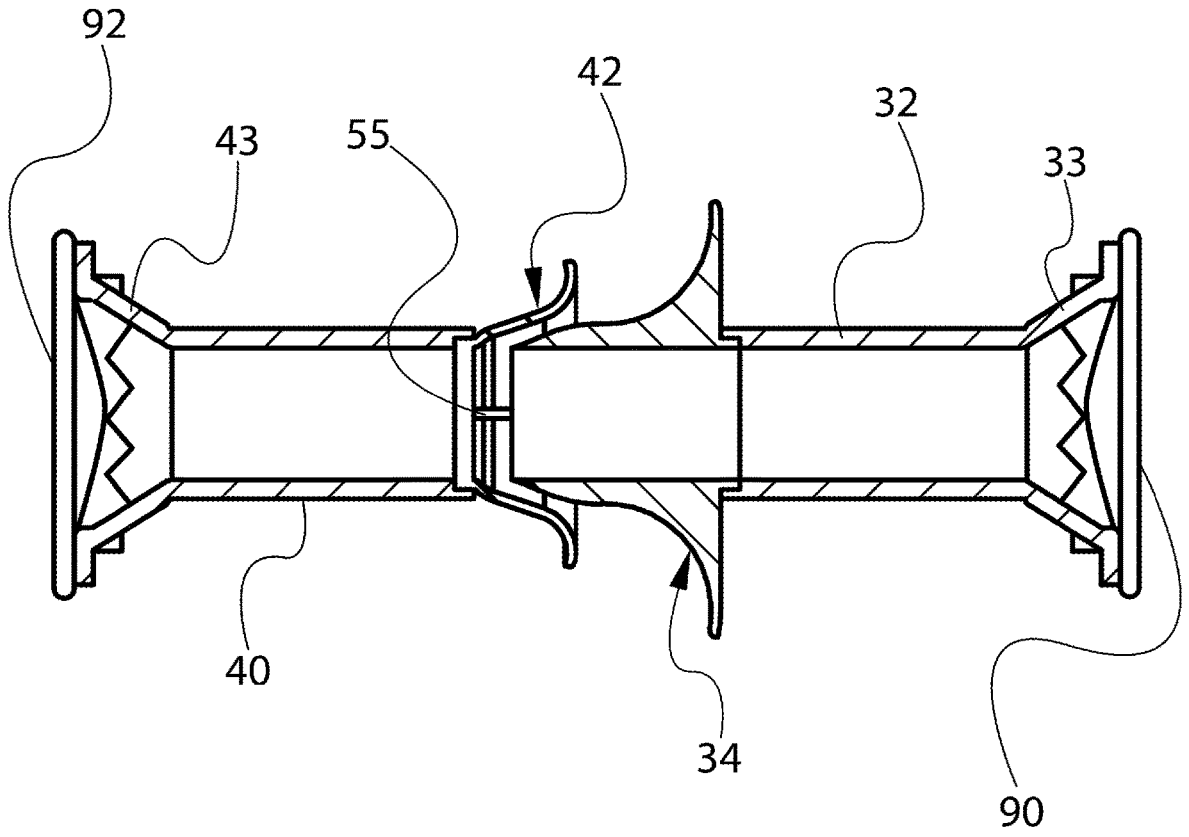
FIG. 10 is a side cross-sectional view of a fifth alternative waveguide embodiment of the present invention.

FIG. 10 illustrates another alternative embodiment similar to that described in connection with FIG. 1. In the FIG. 10 embodiment, like in the FIG. 1 embodiment, the first waveguide section includes a first end 33, first passage 32 and first funnel 34, and the second waveguide section includes a second end 43, second passage 40 and second funnel 42. The FIG. 10 embodiment adds a first covered end 90 and a second covered end 92 configured to block or impede the flow of air from the first passage 32 and the second passage 40 to the enclosure exterior. One or both of the covers may, in some embodiments, comprise a passive radiator.

Figure 11:
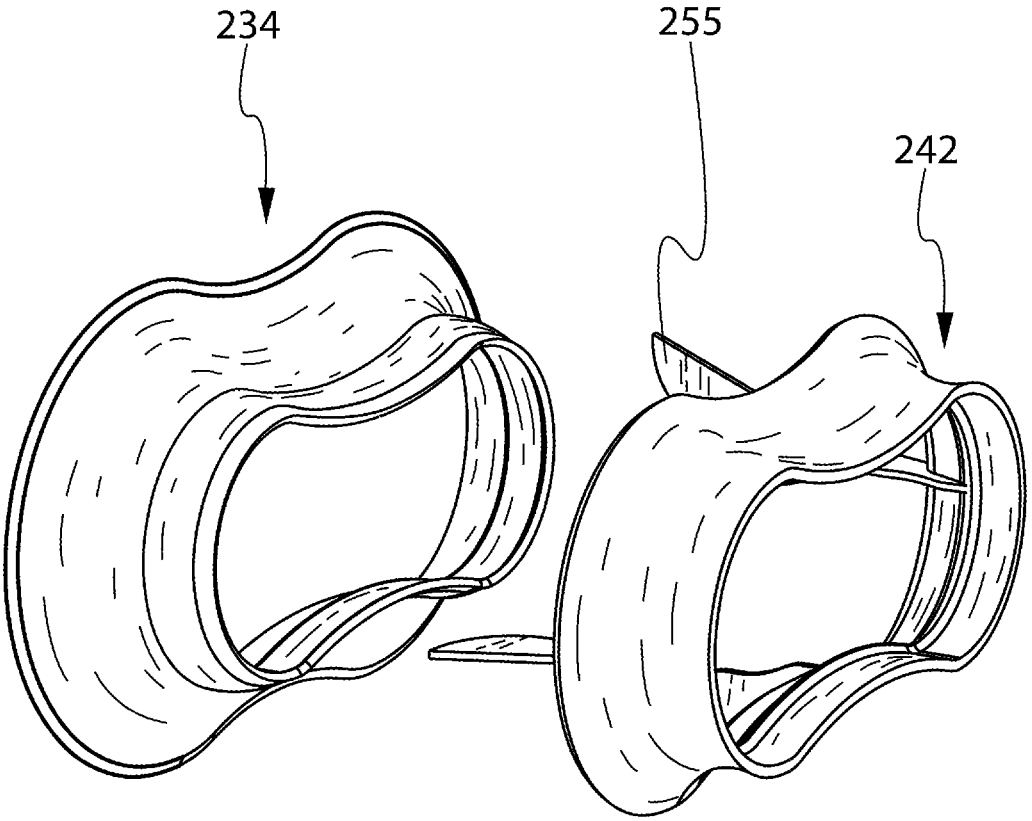
FIG. 11 is an exploded isometric view of portions of a sixth waveguide embodiment of the present invention.

FIG. 11 illustrates a first funnel 234 and a second funnel 242 having non-circular cross sections in accordance with another alternative embodiment of the present invention. Three fins 255 extending from the second funnel 242 may contact the first funnel 234 to maintain a desired separation and air flow space between the funnels.

Figure 12:
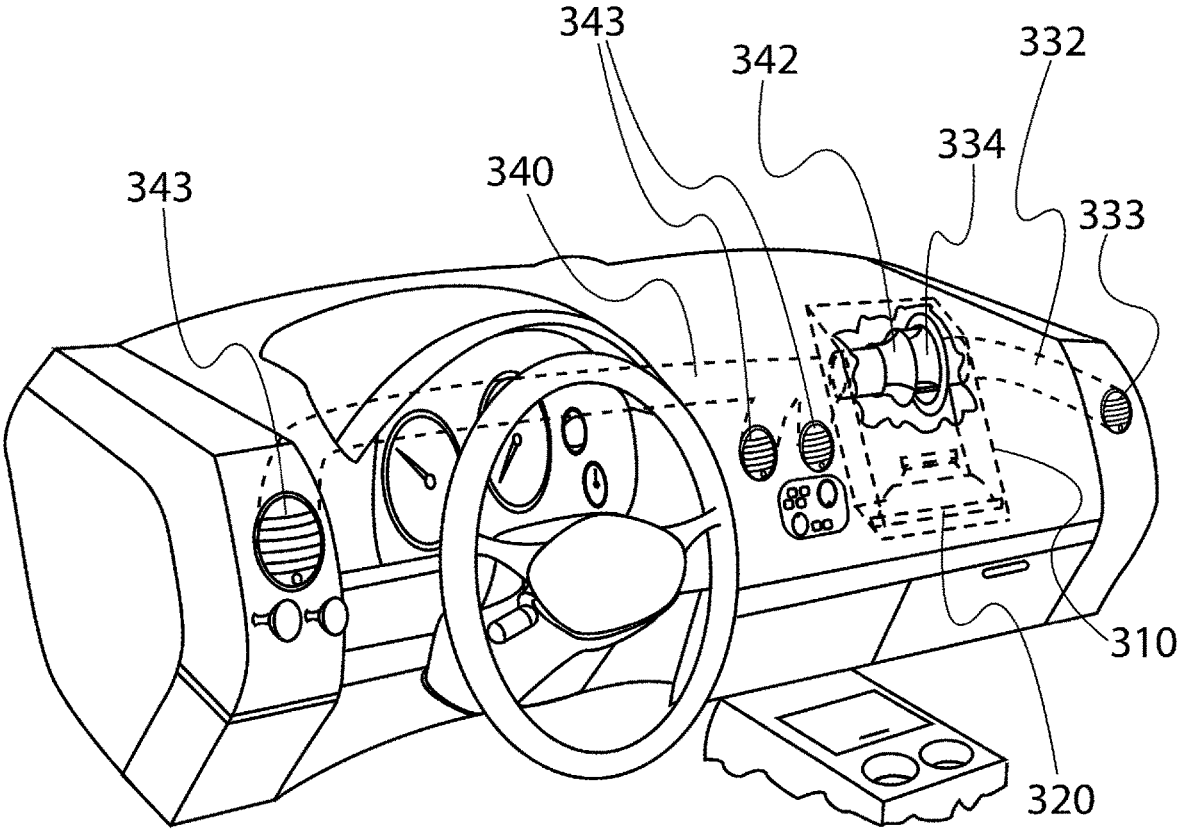
FIG. 12 is a cross-sectional view of a fourth loudspeaker embodiment of the present invention.

FIG. 12 illustrates an alternative embodiment of the present invention for installation of an automobile speaker cone 320 in an automobile ventilation system. The first funnel 334 is connected to a first passage 332 formed by a ventilation conduit leading to a first vent outlet 333 in an automobile, and the second funnel 342 is connected to a second passage 340 leading second vent outlets 343. It is appreciated that the FIG. 12 arrangement could be adapted for use in any ventilation system, not just that of an automobile.

Figure 13:
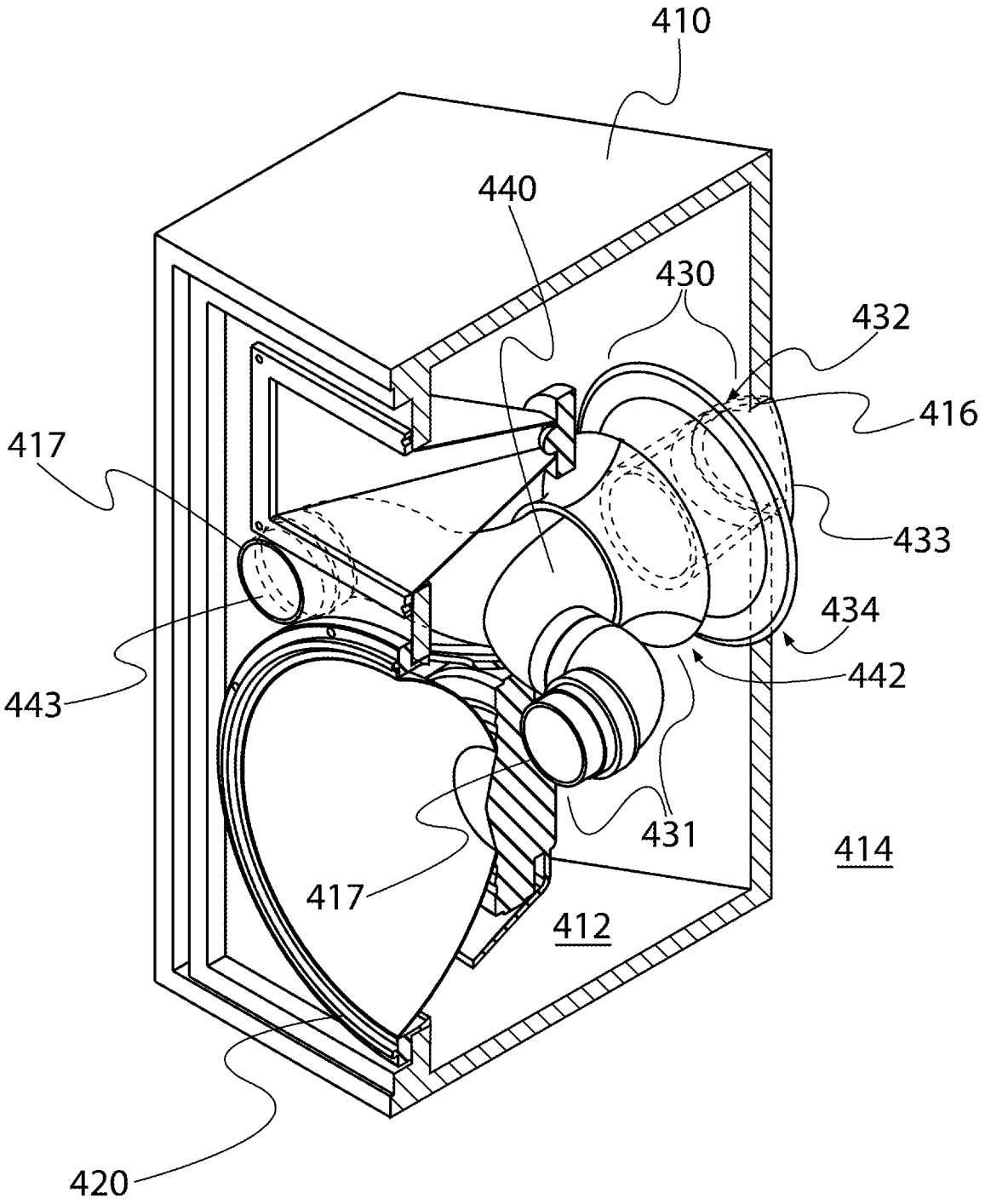
FIG. 13 is a cross-sectional isometric view of a fifth loudspeaker embodiment of the present invention including a seventh y-shaped waveguide embodiment.

With reference to FIG. 13, another alternative loudspeaker embodiment may include an enclosure 410 separating an enclosure interior 412 from an enclosure exterior 414. The enclosure 410 may have an overall three-dimensional trapezoid shape. Multiple openings may extend through the wall of the enclosure 410 providing communication between the enclosure interior 412 and the enclosure exterior 414. For example, a speaker opening may be provided in the enclosure 410 to accommodate a speaker 420 flexibly mounted to the enclosure. Still other openings may be provided in the enclosure 410 for waveguide elements. Specifically, a first waveguide opening 416 and a pair of second waveguide openings 417 may each extend between the enclosure interior 412 and enclosure exterior 414 to accommodate waveguide elements. The first waveguide opening 416 and the second waveguide openings 417 may be disposed on opposed surfaces of the enclosure 410.

A first waveguide section 430 may extend from or through the first waveguide opening 416 into the enclosure interior 412 towards a second waveguide section 431. In this embodiment, the first waveguide section 430 may extend from an enclosure 410 wall that is opposite the wall in which the speaker 420 is mounted, and the second waveguide section 431 may extend from the same enclosure wall in which the speaker is mounted. The first waveguide section 430 may include a first passage 432 extending between a first end 433 and a first funnel 434.

The second waveguide section 431 may be characterized generally as a hollow tube extending between a second end 443 and a second funnel 442. The second waveguide section 431 may include two or more sub-passages that each extend from or through one of the second waveguide openings 417 into the enclosure interior 412 towards the first wave guide section 430. The second waveguide section 431 sub-passages may form a T-shaped or Y-shaped connection with a second passage 440, which in turn is connected to the second funnel 442. The arrangement of the first funnel 434 and the second funnel 442 may be like that described in connection with FIGS. 1-11.

Figure 14:
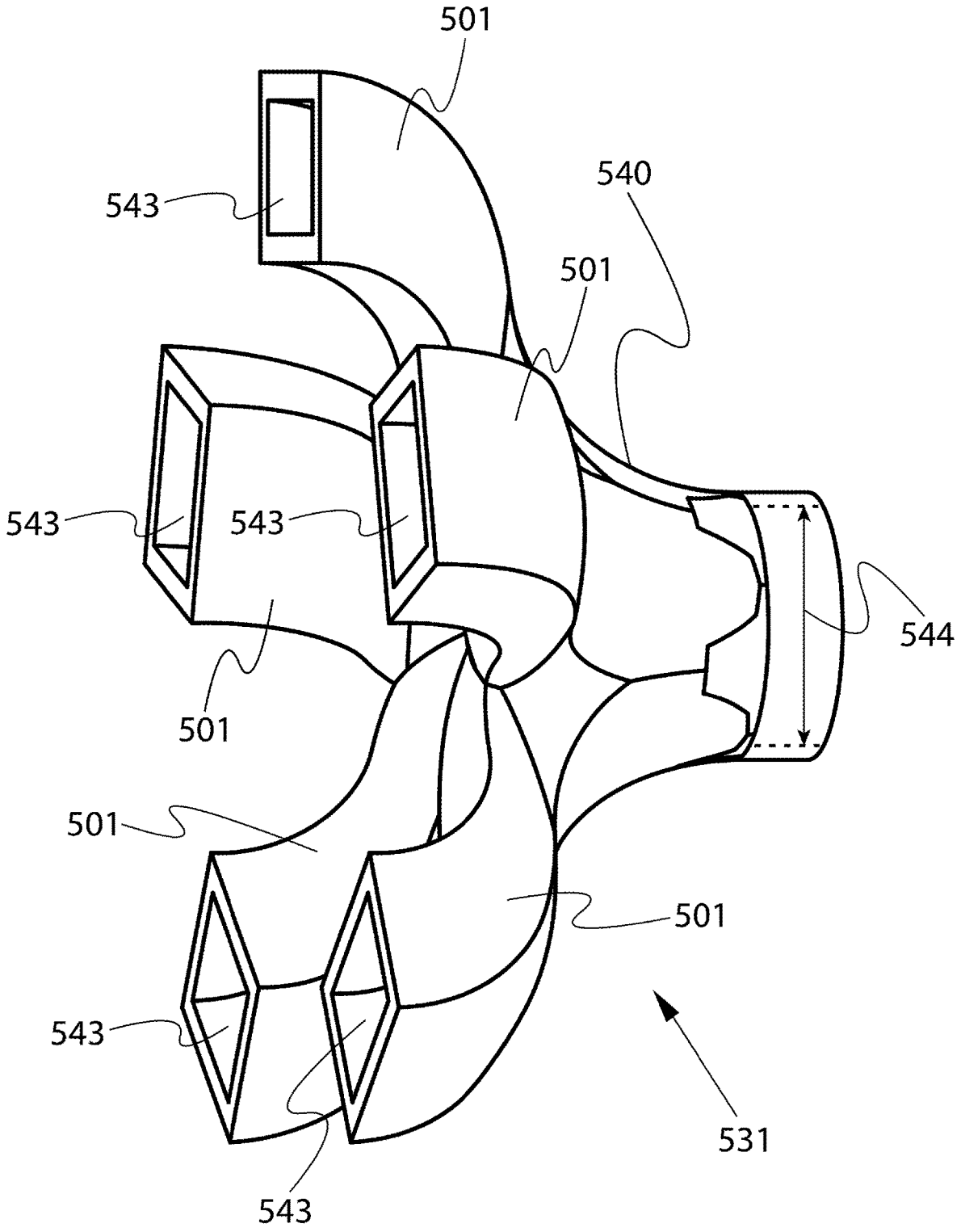
FIG. 14 is an isometric view of a portion of an eighth waveguide embodiment of the invention.

While it may be desirable to locate a large port/vent through the center of a speaker as previously illustrated and discussed, it may also be desirable to locate ports around the outer diameter of the speaker. These outer diameter ports may be used to further assist in focusing/shaping/directing the sound waves emanating from the speaker with or without nozzle or nozzle like structures. These nozzle or nozzle like structures may be used to finely focus/direct/shape the air movements and/or to induce an additional axis of motion. Using this system implementation, it may be possible to shape the produced sound waves into very tightly focused audio stream without the use of modulated ultrasound emitters. These additional ports may be created by hollow cast sections, sheet metal sections, components affixed to the speaker, and/or other similar manufacturing methods. For example, with reference to FIG. 14, an alternative second waveguide section 531 is illustrated. The second waveguide section 531 may include a plurality of sub-passages 501 which extend from ends 543 to a common second passage 544. The sub-passages 501 may have non-circular cross-sections and be of like or dissimilar flux area, volume, and/or shape.

As will be understood by those skilled in the art, the invention may be embodied in other specific forms without departing from the spirit or essential characteristics thereof. The elements described above are illustrative examples of one technique for implementing the invention. One skilled in the art will recognize that many other implementations are possible without departing from the intended scope of the present invention as recited in the claims. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. An audio source comprising:

an enclosure generally defining an enclosure interior and an enclosure exterior, said enclosure having a first opening extending between the enclosure interior and enclosure exterior;

a first waveguide section including a first passage in fluid communication with a first hollow portion of a first funnel, said first funnel including a first surface generally flaring away from the first passage between a first funnel end and a first funnel tip; and a second waveguide section including a second passage in fluid communication with a second hollow portion of a second funnel, said second funnel including a second surface generally flaring away from the second passage between a junction of the second passage with the second funnel and a second funnel end, wherein one or both of the first waveguide section and the second waveguide section extend from the first opening, wherein the first funnel end is disposed within the second hollow portion, and wherein an air flow path extends from the enclosure interior through a space between the first funnel first surface and the second funnel second surface to the first passage and the second passage.

2. The audio source of claim 1, wherein said first waveguide section is proximal to the first opening relative to the second waveguide section.

3. The audio source of claim 1, wherein the first hollow portion extends entirely through the first funnel.

4. The audio source of claim 1, wherein the first hollow portion includes an end wall configured to block air flow through the first funnel.

5. The audio source of claim 4, wherein the first passage is defined by a first passage wall that extends from the first hollow portion through at least a portion of the second passage.

6. The audio source of claim 5, wherein a generally bullet shaped air flow guide extends from the end wall.

7. The audio source of claim 5, wherein a concave walled central peak extends from the end wall towards the first passage.

8. The audio source of claim 1, further comprising a flared first end disposed between the first passage and the first opening, said first end including a generally frusto-conical wall defining a hollow interior that is widest near the first opening.

9. The audio source of claim 1, further comprising a first covered end disposed between the first passage and the enclosure exterior, said first covered end configured to block or impede the flow of air from the first passage to the enclosure exterior.

10. The audio source of claim 1, further comprising a speaker cone mounted to said enclosure, wherein one or both of the first waveguide section and the second waveguide section extend from a center of the speaker cone.

11. The audio source of claim 10 wherein the first funnel is proximal to the speaker cone and the second funnel is distal from the speaker cone.

12. The audio source of claim 10 wherein the first funnel is distal from the speaker cone and the second funnel is proximal to the speaker cone.

13. The audio source of claim 1, wherein the first waveguide section and the second waveguide section are disposed about a common central axis.

14. The audio source of claim 1, wherein the first funnel first surface and the second funnel second surface each have a generally partial toroidal shape.

15. The audio source of claim 1, wherein the first funnel first surface area is greater than the second funnel second surface area.

16. The audio source of claim 1, further comprising:

a second opening extending between the enclosure interior and enclosure exterior, wherein the first waveguide section extends from the first opening, and wherein the second waveguide section extends from the second opening.

17. The audio source of claim 16, further comprising:

a flared first end disposed between the first passage and the first opening; and a flared second end disposed between the second passage and the second opening.

18. The audio source of claim 16, wherein the first funnel and the second funnel are disposed at or near a midpoint between the first opening and the second opening.

19. The audio source of claim 16, wherein the first funnel first surface and the second funnel second surface each have a generally partial toroidal shape.

20. The audio source of claim 16, further comprising a first covered end disposed between the first passage and the enclosure exterior, said first covered end configured to block or impede the flow of air from the first passage to the enclosure exterior.

21. The audio source of claim 1, wherein the first funnel is disposed near or adjacent to an enclosure wall.

22. The audio source of claim 1, further comprising:

a plurality of additional openings extending between the enclosure interior and enclosure exterior;

a plurality of sub-passages extending from the second passage, wherein each of the plurality of sub-passages extends between the second passage and a different one of the plurality of additional openings.

23. The audio source of claim 22 wherein there are only two sub-passages and the two sub-passages form a T-shaped connection with the second passage.

24. The audio source of claim 22 wherein there are only two sub-passages and the two sub-passages form a Y-shaped connection with the second passage.

25. The audio source of claim 22 wherein the sub-passages each have a rectangular cross-section.

* * * * *